US005596621A

United States Patent [19]

Schwarz et al.

[11] Patent Number: 5,596,621

[45] Date of Patent: Jan. 21, 1997

[54] HIGH-VOLTAGE PLUG FOR AN X-RAY TUBE

[75] Inventors: Raimund Schwarz, Forchheim; Thomas Weller, Erlangen, both of Germany

[73] Assignee: Siemens Aktiengesellschaft, Munich, Germany

[21] Appl. No.: 521,911

[22] Filed: Aug. 31, 1995

[30] Foreign Application Priority Data

Sep. 9, 1994 [DE] Germany ..... 44 32 205.4

[51] Int. Cl.[6] ..... H01J 35/10

[52] U.S. Cl. ..... 378/130; 378/199; 378/200

[58] Field of Search ..... 378/130, 132, 378/133, 141, 199, 200, 202

[56] References Cited

U.S. PATENT DOCUMENTS 4,264,818 4/1981 Petersen ..... 378/199

FOREIGN PATENT DOCUMENTS

2448497B2 4/1976 Germany .
3437870A1 7/1985 Germany .
4209377A1 9/1993 Germany .

*Primary Examiner*—Don Wong
*Attorney, Agent, or Firm*—Hill, Steadman & Simpson

[57] ABSTRACT

A high-voltage plug for an X-ray tube plugs onto a high-voltage terminal provided at the vacuum housing of the X-ray tube. The high-voltage plug contains a cooling channel for a coolant. An improved are over protection results by use of the coolant.

8 Claims, 3 Drawing Sheets

HIGH-VOLTAGE PLUG FOR AN X-RAY TUBE

BACKGROUND OF THE INVENTION

The invention is directed to a high-voltage plug for an X-ray tube that is provided for plugging to a high-voltage terminal provided at a vacuum housing of the X-ray tube.

Such high-voltage plugs are disclosed, for example, by DE 24 48 497 B2. In the use of such high-voltage plugs with a corresponding X-ray tube, it has been shown that there is a risk of voltage arc-overs between the voltage-carrying part of the high-voltage plug and the vacuum housing of the X-ray tube lying at a different potential, particularly ground potential. It is obvious that such voltage arc-overs are undesirable since they negatively affect both the service life of the high-voltage plug as well as of the X-ray tube.

SUMMARY OF THE INVENTION

An object of the invention is to provided a high-voltage plug of the type initially cited such that an improved electric strength results.

According to the invention, a high-voltage plug for an X-ray tube is provided for plugging to a high-voltage terminal provided at the vacuum housing of the X-ray tube and that contains a cooling channel for a coolant. It has been surprisingly shown that an improved electric strength results by cooling the high-voltage plug. Liquid or gaseous agents are suitable as coolant. Insulating oil as is normally present in the protective housing that accepts the X-ray tube is especially suitable. Under certain circumstances, there is even the possibility of using the insulating oil present in the protective housing for also cooling the high-voltage plug.

It is provided according to one embodiment of the invention that the high-voltage plug comprises an engagement surface provided for interaction with a corresponding surface of the high-voltage terminal of the X-ray tube, the cooling channel proceeding under this engagement surface. An additionally improved electric strength results since the cooling is not limited to the high-voltage plug, but also covers the parts of the X-ray tube lying in the area of the high-voltage terminal. When the high-voltage plug contains a contact part that is formed of an electrically conductive material and that has a contact surface that is provided for interaction with a part of the X-ray tube that comprises a corresponding surface, it is advantageous when the contact surface forms the engagement surface. Then, a special engagement surface does not have to be provided, so that a compact structure of the high-voltage plug as well as of the high-voltage terminal results.

According to a preferred embodiment of the invention, the cooling channel of the high-voltage plug comprises an interruption because the coolant charges a part of the X-ray tube in the region of the interruption. This can occur in that the cooling channel discharges into a channel provided in a part of the X-ray tube in the region of the interruption, this latter channel in turn discharging into the cooling channel. It can also be provided, however, that the cooling channel discharges into a channel provided in a part of the X-ray tube without having the other end of this channel being in communication with the cooling channel. In both instances, an improved electric strength is achieved by cooling the high-voltage terminal or the region of the X-ray tube adjacent to the high-voltage terminal.

Beyond this, it can be provided that the part that is charged with the coolant or that contains the channel is a part having a thermally conductive connection to the anode and/or a part having a thermally conductive connection to the bearing of the rotating anode in the case of a rotating anode X-ray tube. Not only is an improved electric strength then assured, but a cooling of the anode and/or the bearing of the (rotating) anode is also advantageously achieved. It is especially structurally simple when the part is a matter of a hollow axle or a hollow shaft known per se from DE A 34 37 870 A1.

An X-ray tube having a vacuum housing with a high-voltage terminal and a high-voltage plug interacting with the high-voltage terminal such that the risk of voltage arc-overs between the high-voltage plug and the vacuum housing is reduced is achieved by an X-ray tube whose high-voltage plug is designed according to the present invention.

DESCRIPTION OF THE PREFERRED EMBODIMENTS

Figure 1:
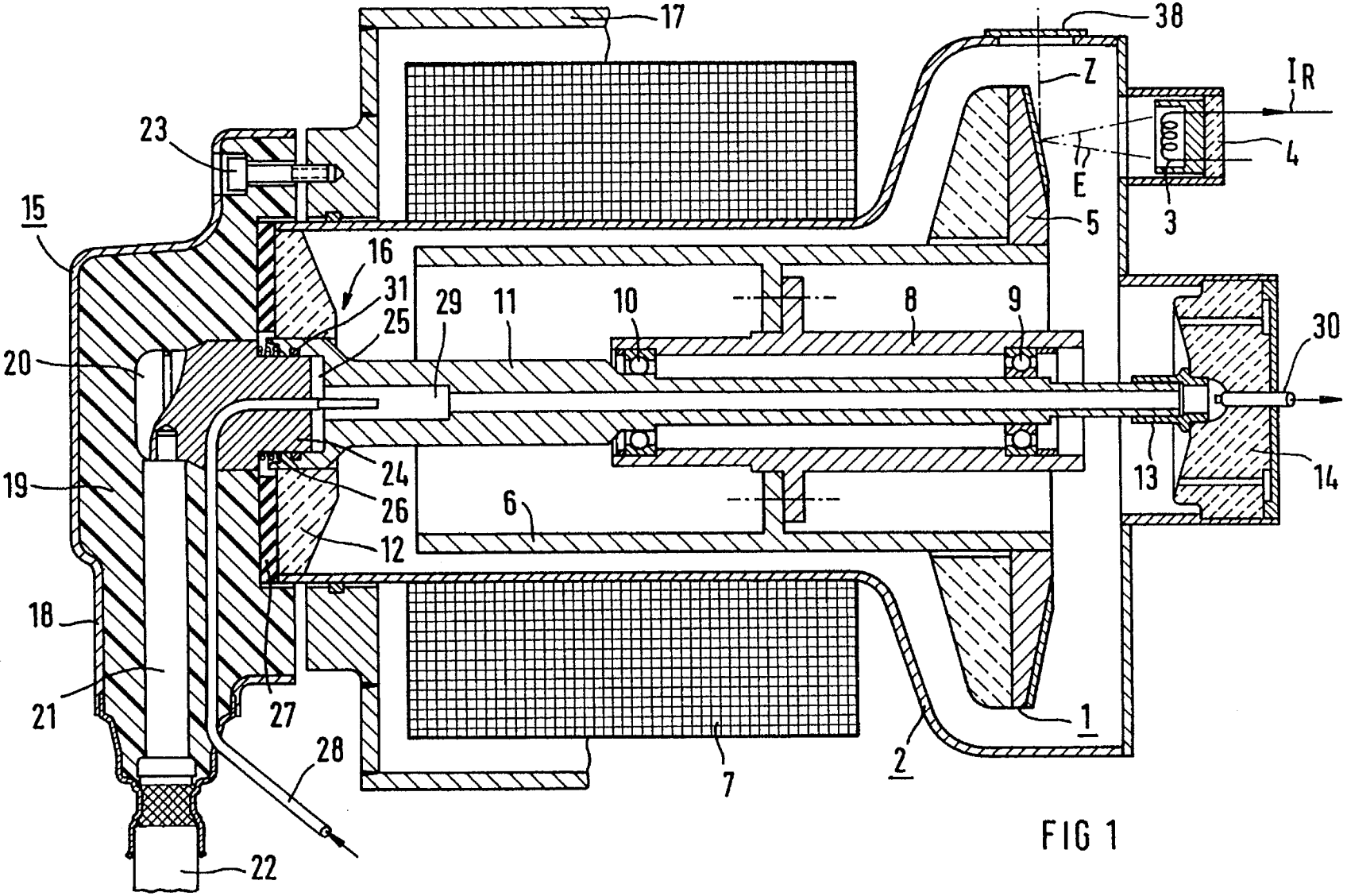
FIG. 1 is a schematic illustration of an X-ray tube with a high-voltage plug of the invention.

FIG. 1 shows an X-ray tube that comprises a rotating anode arrangement referenced 1 overall that is accommodated in a vacuum housing 2. In a known way, the vacuum housing 2 also contains a cathode arrangement in whose cathode cup 4 a glow coil 3 is accepted.

The rotating anode arrangement 1 comprises an anode dish that is connected to the one end of a tubular component part that serves as rotor of the electric motor provided for the drive of the rotating anode arrangement 1 and that is referenced 6. The stator 7 of the electric motor is put in place at the outside on the vacuum housing 2 in the region of the rotor 6.

A bearing sleeve 8 is connected to the rotor 6 via a flange joint; the screws are indicated merely as dot-dash lines. The outer rings of the rolling bearings 9 and 10 are accepted in the bore thereof, these serving the purpose of rotatably seating the rotating anode arrangement 1 on a stationary bearing axle 11 with the rolling bearings 6, 10.

At its one end, the bearing axle 11 is connected to an annular ceramic part 12 of the vacuum housing 2. At its other end, the bearing axle 11 is connected via a metallic sleeve 13 to an annular ceramic part 14 that is accepted in a corresponding pot-shaped projection of the vacuum housing 2.

In the case of the X-ray tube according to FIG. 1, the delivery of the tube current occurs by a high-voltage plug-type connection, i.e. with a high-voltage plug 15 that is plugged onto a region of the vacuum housing 2 designed as a high-voltage terminal 16. In a way known per se from DE 42 09 377 A1, the region of the vacuum housing 2 designed as a high-voltage terminal 16 lies outside a protective housing 17 (only partially shown in FIG. 1) that accepts the X-ray tube for the formation of an X-ray radiator.

When the X-ray tube is supplied with tube current, the conductance of the tube current occurs via one of the terminals of the glow coil 3; when a filament voltage is applied between the two terminals of the glow coil 3 and when the stator is supplied with operating voltage, an electron beam E emanates from the glow coil 3 and impinges the rotating anode dish 5 in what is referred to as the focal spot; an X-ray beam then emanates from the focal spot, this beam emerging from the vacuum housing 2 through the beam exit window 38. The central ray of the X-ray beam is referenced Z in FIG. 1.

The high-voltage plug 15 comprises an insulator part 19 surrounded by a sheet metal housing 18 and in which a contact part 20 is embedded. The contact part 20 has an electrically conductive connection to a lead 21 since a peg-shaped projection of the lead 21 is inserted into a transverse hole of the contact part 20. A high-voltage cable 22 is attached to the free end of the lead with a crimp connection.

The contact part 20 designed in dynamically balanced fashion comprises the outer generated surface of a cylindrical projection as an engagement or contact surface with which it engages into a correspondingly shaped depression 25 at the end face of the bearing axle 11 and interacts with the wall of the depression.

In order to enable the conduction of the anode current under all circumstances, a contact spring 26 is arranged between a shoulder of the contact part 20 and the end face of the bearing axle 11. An elastically resilient insulator disk 27 that, for example, can be composed of silicone rubber, is arranged between the annular end face of the part 12 and a corresponding surface of the insulator part 19. The insulator disk 27 is intended to prevent voltage arc-overs between the contact part 20, the contact spring 26 and the end face of the bearing axle 11 on the one hand, and that part of the vacuum housing 2 that accepts the ceramic component part 12 and extends outward through the protective housing 17.

The high-voltage plug 15 is secured to the protective housing 17 with a few screws, only one thereof being visible in FIG. 1 and being referenced 23. It is self-evident that the X-ray tube is stationarily fixed inside the protective housing 17 in a known way.

A cooling channel flooded by a coolant is provided for cooling in the region of the high-voltage plug 15 and of the high-voltage terminal 16 of the X-ray tube for the sake of a high electric strength. This cooling channel is formed by a hose that is conducted through the insulator part 19 of the high-voltage plug 15 to the contact part 20. The cooling channel proceeds under the engagement or contact surface of the contact part 20 from which it emerges in the region of the end face of the projection 24. It discharges into a channel of a component part of the X-ray tube, namely the central opening 29 of the bearing axle 11 designed as a hollow shaft.

The coolant, for example a special cooling oil or the insulating oil present in the protective housing, thus flows through not only the high-voltage plug 15 but also charges a component part of the high-voltage, namely the bearing axle 11, in that it flows therethrough and reemerges at the end thereof accepted in the sleeve 13. The coolant is admitted and eliminated through a line 30.

Since the bearing axle 11 is in thermally conductive communication with, on the one hand, the rolling bearings 9, 10 and, on the other hand, with the anode dish 5 via the rolling bearings 9, 10 as well as the bearing sleeve 8 and the rotor 6, an improved heat elimination from the anode dish 5 and, at the same time, an improved cooling of the rolling bearings 9, 10 is assured as a result of the coolant flow through the bearing axle 11.

It is self-evident that the connection of the bearing axle 11 to the sleeve 13, the connection of the sleeve 13 to the ceramic component part 14, the bushing of the line 30 through the ceramic component part 14 and, potentially, the bushing of the line through the floor of the projection of the vacuum housing 2 that accepts the ceramic component part 14 must be vacuum-tight.

A seal ring 31 is provided in order to prevent the emergence of coolant in the region of the other end of the bearing axle 11.

Figure 2:
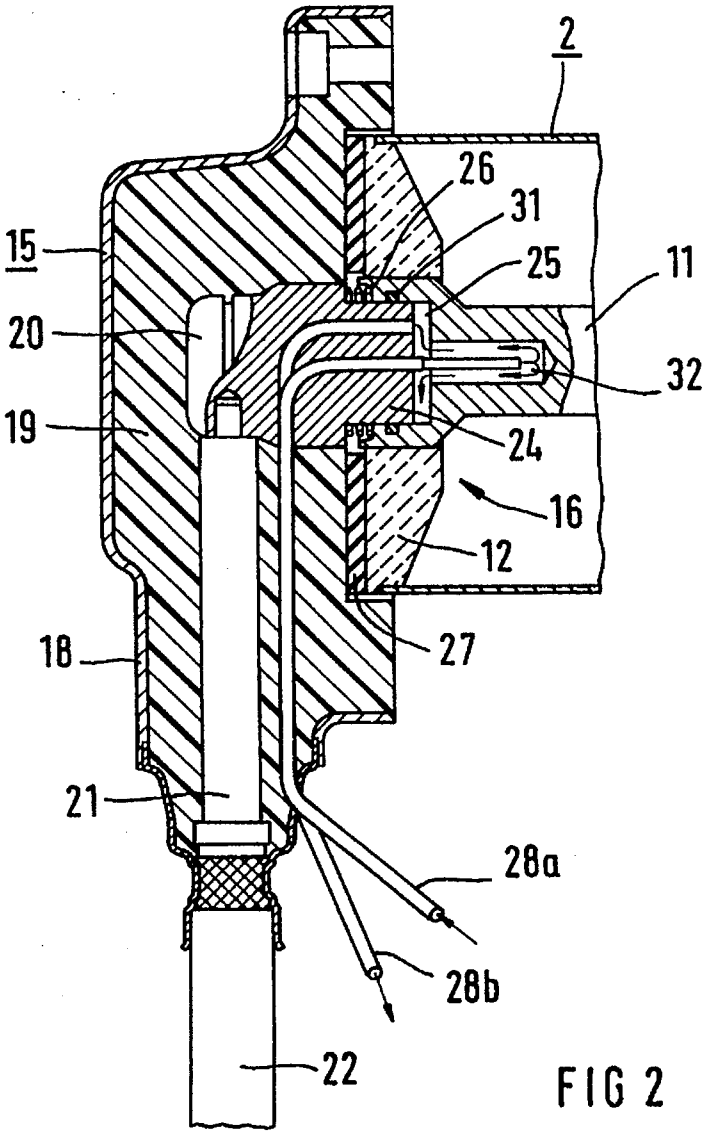

The exemplary embodiment of FIG. 2 differs from that set forth above in that the cooling channel comprises an interruption and the coolant charges a part of the X-ray tube, namely the end of the bearing axle 11, in the region of the interruption. The interruption of the cooling channel is realized in that two hoses **28*a* and 28*b* are provided, whereby the hose 28*a* serves the purpose of delivering and the hose 28*b* serves the purpose of eliminating the coolant. Similar to the hose 28 in the exemplary embodiment of FIG. 1, the hoses 28*a* and 28*b* are conducted through the insulator part 19 of the high-voltage plug 15. They emerge from the contact part 20 in the region of the end face of the projection 24**.

For the sake of beneficial flow conditions as well as for enlarging the area of the bearing axle 11 charged by the coolant, the bottom surface of the depression 25 is provided with a blind hole 32 into which the hose **28*a*** projects.

Figure 3:
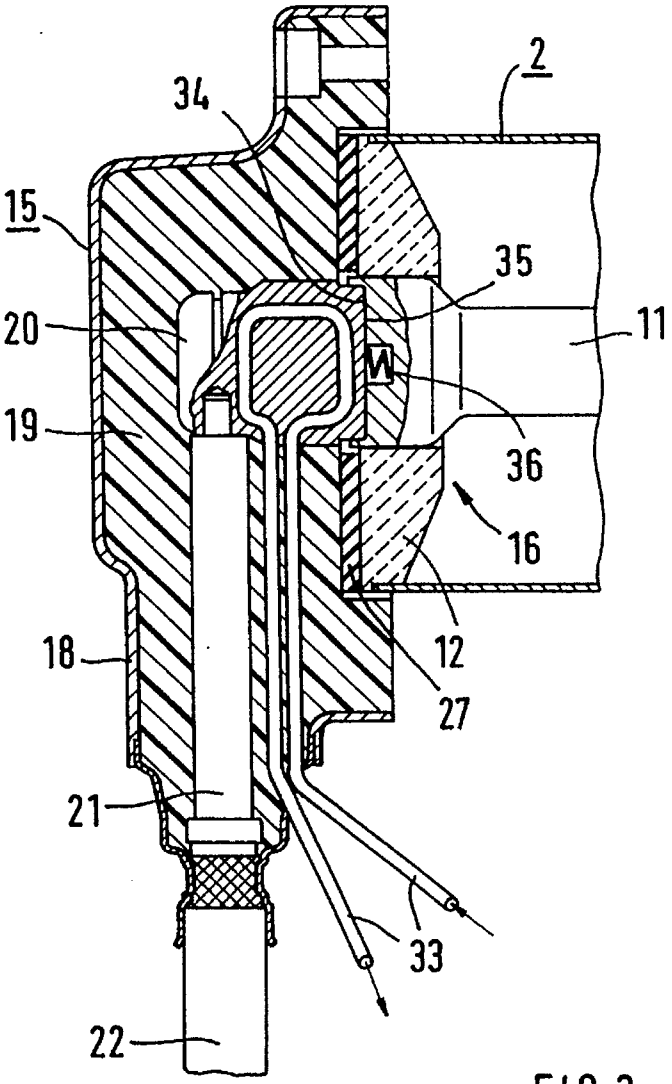
FIGS. 2 and 3 illustrate in a partial illustration analogous to FIG. 1, further X-ray tubes having a high-voltage plug of the invention.

The exemplary embodiment of FIG. 3 differs from that according to FIG. 2 in that the cooling channel is implemented without interruption. Accordingly, it is formed by a single hose 33 that proceeds in a loop inside the contact part 20. The desired cooling in the region of the high-voltage plug-type connection 16 is achieved as a result thereof.

The loop formed by the hose 33 comprises a region that proceeds at a slight depth under the end face of the contact part 20, proceeding in the contact part 20 along the end face thereof. The end face forms a contact or engagement surface 34 via which the contact part 20 interacts with a corresponding surface 35 of the bearing axle 11.

In order to assure a reliable conduction of the tube current under all circumstances, a contact spring referenced 36 is again provided. This is accepted in a blind hole that is applied in the surface 35 of the bearing axle 11.

Since, as set forth in conjunction with FIG. 1, the bearing axle 11 is in thermally conductive communication both with the rolling bearings 9 and 10 as well as with the anode dish 5, a heat elimination from the rolling bearings or the anode dish 5 is also assured in the exemplary embodiments of FIGS. 2 and 3.

In the exemplary embodiment of FIG. 3, the loop formed by the hose 33 proceeds in a plane that contains the center axis of the bearing axle 11. This need not necessarily be the case, as may be seen from FIGS. 4 and 5. In these two FIGS, the loop proceeds in a plane residing at a right angle relative to the center axis of the bearing axle 11. A U-shaped loop is provided in the case of FIG. 4; and the loop in FIG. 5 forks into two arms **37*a* and 37*b***.

A rotating bearing sleeve and a stationary bearing axle are respectively provided for bearing the rotating anode in the exemplary embodiments that have been set forth. It is self-evident that a stationary bearing sleeve and a rotating bearing axle can be provided instead. Likewise, plain bearings can be provided in a known way instead of the rolling bearings provided for bearing the rotating anode in the exemplary embodiments.

The invention is not limited to X-ray tubes having rotating anodes; it can also be utilized in X-ray tubes having fixed anodes.

Furthermore, the high-voltage plug-type connection need not necessarily lie outside the protective housing, as in the exemplary embodiments that were described. The invention can also be utilized when the high-voltage plug-type connection is located inside the protective housing.

Figure 4:
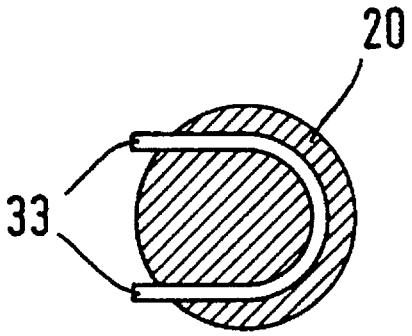
FIGS. 4 and 5 are modifications of the high-voltage plug of FIG. 3 in a partial view.
Figure 5:
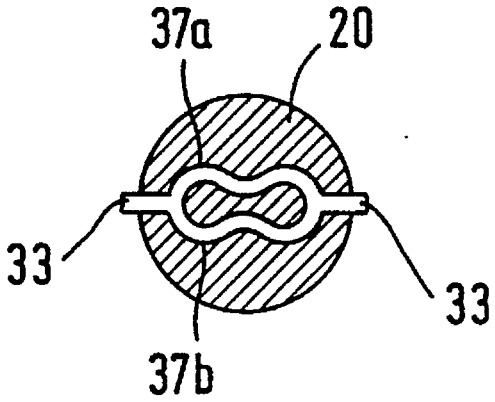

The exemplary embodiments that have been described refer to the anode-side arrangement of a high-voltage plug provided with a cooling channel. The use of such a plug, however, can also occur at the cathode side. In this case, the embodiments according to FIGS. 3 through 5 are especially suitable.

In the exemplary embodiments that have been described, the cooling channel is formed by a hose. Other solutions are also possible; for example, the cooling channel can be implemented as a bore that is in communication with an appropriate conduit.

We claim as our invention:

1. An X-ray tube system, comprising:

an X-ray tube having a high-voltage terminal provided at a vacuum housing of the X-ray tube;

a high-voltage plug for plugging onto said high-voltage terminal, said high-voltage plug containing a cooling channel for a coolant;

said high-voltage plug having an engagement surface provided for interaction with a corresponding surface of said high-voltage terminal of said X-ray tube;

said high-voltage plug having a contact part formed of an electrically conductive material and containing as said engagement surface a contact surface provided for interaction with said high-voltage terminal corresponding surface; and said X-ray tube having a rotating anode, and said high-voltage terminal corresponding surface interacting with said high-voltage plug being in thermally conductive connection with a bearing of said rotating anode.

2. A system according to claim 1 wherein said cooling channel in said high-voltage plug is in communication with a hollow axle of the rotating anode so that coolant flowing through said high-voltage plug cooling channel also flows through said hollow axle.

3. A system according to claim 1 wherein the high-voltage plug cooling channel comprises a loop with in-feed and return lines respectively to and from said contact part.

4. A system according to claim 1 wherein the cooling channel of said high-voltage plug discharges into a hollow axle of said rotating anode.

5. An X-ray tube system, comprising:

an X-ray tube having a high-voltage terminal provided at a vacuum housing of the X-ray tube;

a high-voltage plug for plugging onto said high-voltage terminal, said high-voltage plug containing a cooling channel for a coolant;

said cooling channel of said high-voltage plug having an interruption, the coolant charging a portion of the X-ray tube in a region of said interruption; and said X-ray tube having a rotating anode, and wherein said portion of said X-ray tube charged with said coolant is in thermally conductive connection with a bearing of said rotating anode of said X-ray tube.

6. A system according to claim 5 wherein one end of the bearing axle of said rotating anode as a blind hole and wherein said interruption is adjacent said blind hole so as to allow coolant to flow from said interruption into and out of said blind hole.

7. An X-ray tube system, comprising:

an X-ray tube having a high-voltage terminal provided at a vacuum housing of the X-ray tube;

a high-voltage plug for plugging onto said high-voltage terminal, said high-voltage plug containing a cooling channel for a coolant;

said cooling channel of said high-voltage plug discharging into a channel provided in a portion of said X-ray tube; and said X-ray tube having a rotating anode, and wherein said portion of said X-ray tube having the channel into which said cooling channel discharges is in thermally conductive connection with a bearing of said rotating anode of said X-ray tube.

8. A system according to claim 7 wherein said rotating anode has a hollow axle serving as said channel in said X-ray tube into which said cooling channel discharges.

* * * * *